United States Patent [19]

Papay et al.

[11] 4,293,432

[45] Oct. 6, 1981

[54] LUBRICATING OIL COMPOSITION

[75] Inventors: Andrew G. Papay, Manchester; Joseph P. O'Brien, Kirkwood, both of Mo.

[73] Assignee: Ethyl Corporation, Richmond, Va.

[21] Appl. No.: 85,968

[22] Filed: Oct. 18, 1979

[51] Int. Cl.[3] ..... C10M 1/46; C10M 1/36; C10M 3/40; C10M 3/20

[52] U.S. Cl. ..... 252/49.9; 252/51.5 A

[58] Field of Search ..... 252/51.5 A, 49.9

[56] References Cited

U.S. PATENT DOCUMENTS

| | | | |
|---|---|---|---|
| 2,018,758 | 10/1935 | Ellis | 252/51.5 A |
| 2,238,478 | 4/1941 | Ott | 252/42 |
| 2,403,067 | 7/1946 | Fischer et al. | 252/51 |
| 2,967,831 | 1/1961 | Hommer | 252/77 |
| 3,070,546 | 12/1962 | Bulter et al. | 252/32.7 E |
| 3,509,052 | 4/1970 | Murphy | 252/34.7 |
| 3,778,375 | 12/1973 | Braid et al. | 252/49.9 |
| 4,151,101 | 4/1979 | Anzenberger et al. | 252/51.5 A |
| 4,152,276 | 5/1979 | Jackisch | 252/51.5 A |

FOREIGN PATENT DOCUMENTS

| | | | |
|---|---|---|---|
| 1247541 | 9/1971 | United Kingdom | 252/49.8 |

*Primary Examiner*—Delbert E. Gantz
*Assistant Examiner*—Irving Vaughn
*Attorney, Agent, or Firm*—Donald L. Johnson; John F. Sieberth; Joseph D. Odenweller

[57] ABSTRACT

Engine friction is reduced by using in the engine crankcase a formulated motor oil containing a small amount of a reaction product of a fatty acid and monoethanolamine. A di-lower alkyl hydrocarbylphosphonate can optionally be included.

8 Claims, No Drawings

LUBRICATING OIL COMPOSITION

BACKGROUND

In order to conserve energy, automobiles are now being engineered to give improved gasoline mileage compared to those in recent years. This effort is of great urgency as a result of Federal regulations recently enacted which compel auto manufacturers to achieve prescribed gasoline mileage. These regulations are to conserve crude oil. In an effort to achieve the required mileage, new cars are being down-sized and made much lighter. However, there are limits in this approach beyond which the cars will not accommodate a typical family.

Another way to improve fuel mileage is to reduce engine friction. The present invention is concerned with this latter approach.

Turbine oil containing as a corrosion inhibitor the reaction product of oleic acid and an alkanol amine is disclosed in U.S. Pat. No. 2,403,067. Monopropanolamine is not useful because it has too low a molecular weight.

Alkanolamine esters of organic acids are used as load-carrying additives in U.S. Pat. No. 2,018,758. Triethanolamine is preferred.

Water-based hydraulic fluids are described in U.S. Pat. No. 2,967,831. The oil used in making the water emulsion contains about 50% of an emulsifier formed by reacting a fatty acid with an alkanolamine.

Lubricating oil containing an ashless dispersant and a demulsifier for water-in-oil emulsion is disclosed in U.S. Pat. No. 3,509,052. The commercial additive "Ethomid" (registered trademark, Armak Company) is mentioned. This is a polyethoxylated oleamide.

Cutting oils and metal forming oils containing higher fatty acid esters of alkylol amines are described in U.S. Pat. No. 2,238,478.

Crankcase oil containing phosphonate friction reducers is disclosed in U.S. Pat. No. 4,158,633.

SUMMARY

According to the present invention engine friction is reduced by operating the engine using a motor oil formulated for use in an engine crankcase containing a small amount of the reaction product of a $C_{12-22}$ fatty acid and monoethanolamine.

DESCRIPTION OF THE PREFERRED EMBODIMENTS

A preferred embodiment of the invention is a lubricating oil composition formulated for use in the crankcase of an internal combustion engine containing a friction-reducing amount of the reaction product made by the process comprising heating a mixture of a fatty acid containing about 12–22 carbon atoms and monoethanolamine while distilling out water formed in the reaction.

A further embodiment of the invention is a method of reducing friction in an internal combustion engine, said method comprising (1) adding to a lubricating oil a friction-reducing amount of the reaction product formed by heating a mixture of a fatty acid containing about 12–22 carbon atoms and monoethanolamine while distilling out water formed in the reaction and (2) placing said lubricating oil in the crankcase of an internal combustion engine.

The additives are made by forming a reaction mixture of the fatty acid and monoethanolamine and heating the mixture to remove water formed in the reaction. A water immiscible inert solvent such as heptene, toluene or xylene can be included as an aid in removing water by codistillation.

About 0.5–2 moles of fatty acid are used per mole of monoethanolamine. Of course, less fatty acid can be used which will result in unreacted monoethanolamine. This can be removed. A preferred range is about 0.9–1.2 moles of fatty acid per mole of monoethanolamine.

The reaction proceeds to give mainly amides according to the equation:

$$R{-}COOH + H_2NCH_2CH_2OH \longrightarrow R{-}\overset{\overset{\displaystyle O}{\|}}{C}{-}NHCH_2CH_2OH$$

wherein R is the hydrocarbon residue of the fatty acid.

Some of the fatty acid will react to form esters according to the following equation:

$$R{-}COOH + HOCH_2CH_2NH_2 \longrightarrow R{-}\overset{\overset{\displaystyle O}{\|}}{C}{-}OCH_2CH_2NH_2$$

Likewise, ester-amide products can form according to the following equation:

$$2\,RCOOH + H_2NCH_2CH_2OH \longrightarrow R{-}\overset{\overset{\displaystyle O}{\|}}{C}{-}NH{-}CH_2CH_2{-}O{-}\overset{\overset{\displaystyle O}{\|}}{C}{-}R$$

The last reaction becomes a significant factor in compositions wherein the amount of fatty acid is in excess of one mole per mole of monoethanolamine.

The components in the resulting reaction product are not separated, but are used as a mixture after removing volatile materials such as solvents and starting material.

Preferred fatty acids used in making the friction-reducing additives are those containing about 12–22 carbon atoms. Examples of these are lauric acid, tridecanoic acid, myristic acid, stearic acid, arachidic acid and the like. More preferably the fatty acid is an unsaturated fatty acid such as hypogaeic acid, oleic acid, elaidic acid, erucic acid, brassidic acid and the like including mixtures of such fatty acid, e.g. tall oil acids and other fatty acids derived from naturally occurring fats and oils.

Most preferably the fatty acid is oleic acid. Thus, the preferred additive components are N-(2-hydroxyethyl-)oleamide and 2-aminoethyl oleate and mixtures thereof.

The following example illustrates the method of making the present additives.

EXAMPLE 1

In a reaction vessel was placed 141 grams (0.5 mole) of oleic acid and 63 grams (0.6 mole) of monoethanolamine. The mixture was stirred and heated to 160° C. at which time gelling occurred. The reaction was cooled and sufficient heptane added to make the mixture stirable. The mixture was again heated and cleared at 100° C. Water was distilled out using heptane codistillation and a Dean Stark water separator. After two hours refluxing to remove water, 30" of vacuum was applied to distill out heptane and other volatiles up to 110° C. leaving a useful friction-reducing additive. The major component was N-(2-hydroxyethyl)oleamide plus minor amounts of 2-aminoethyloleate.

Other additives can be made following the above general procedure by substituting different fatty acids.

The additives are added to lubricating oil in an amount which reduces the friction of an engine operating with the oil in the crankcase. A useful concentration is about 0.05–3 weight percent. A more preferred range is about 0.1–1.5 weight percent.

From the above it can be seen that the present invention provides an improved crankcase lubricating oil. Accordingly, an embodiment of the invention is an improved motor oil composition formulated for use as a crankcase lubricant in an internal combustion engine wherein the improvement comprises including in the crankcase oil an amount sufficient to reduce fuel consumption of the engine of the present additives.

In a highly preferred embodiment such improved motor oil also contains an ashless dispersant, a zinc dialkyldithiophosphonate and an alkaline earth metal salt of a petroleum sulfonic acid or an alkaryl sulfonic acid (e.g. alkylbenzene sulfonic acid).

The additives can be used in mineral oil or in synthetic oils of viscosity suitable for use in the crankcase of an internal combustion engine. Crankcase lubricating oils have a viscosity up to about 80 SUS at 210° F. According to the present invention the additives function to increase fuel economy when added to lubricating oil compositions formulated for use in the crankcase of internal combustion engines. Similar mileage benefits could be obtained in both spark ignited and diesel engines.

Crankcase lubricating oils of the present invention have a viscosity up to about SAE 40. Sometimes such motor oils are given a classification at both 0° and 210° F., such as SAE 10W 40 or SAE 5W 30.

Mineral oils include those of suitable viscosity refined from crude oil from all sources including Gulfcoast, midcontinent, Pennsylvania, California, Alaska and the like. Various standard refinery operations can be used in processing the mineral oil.

Synthetic oil includes both hydrocarbon synthetic oil and synthetic esters. Useful synthetic hydrocarbon oils include liuqid polymers of $\alpha$-olefins having the proper viscosity. Especially useful are the hydrogenated liquid oligomers of $C_{6-12}$ $\alpha$-olefins such as $\alpha$-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetraceproate, di-(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oils are particularly useful. For example, blends of 10–25 weight percent hydrogenated $\alpha$-decene trimer with 75–90 weight percent 150 SUS (100° F.) mineral oil results in an excellent lubricant. Likewise, blends of about 10–25 weight percent di-(2-ethylhexyl)adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 5W 20) since they permit these low viscosities without contributing excessive volatility.

The more preferred lubricating oil composition includes zinc dihydrocarbyldithiophosphate (ZDDP) in combination with the present additives. Both zinc dialkyldithiophosphates and zinc dialkaryldithiophosphates as well as mixed alkyl-aryl ZDDP are useful. A typical alkyl-type ZDDP contains a mixture of isobutyl and isoamyl groups. Zinc di-(nonylphenyl)dithiophosphate is a typical aryl-type ZDDP. Good results are achieved using sufficient ZDDP to provide about 0.01–0.5 weight percent zinc. A preferred concentration supplies about 0.05–0.3 weight percent zinc.

Another additive used in the oil compositions are the alkaline earth metal petroleum sulfonates or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 weight percent alkaline earth metal and more preferably about 0.1–1.0 weight percent. In a most preferred embodiment the lubricating oil composition contains a calcium petroleum sulfonate or alkaryl (e.g. alkylbenzene) sulfonate.

Viscosity index improvers can be included such as the polyalkylmethacrylate type or the ethylene-propylene copolymer type. Likewise, styrene-diene VI improvers or styrene-acrylate copolymers can be used. Alkaline earth metal salts of phosphosulfurized polyisobutylene are useful.

Most preferred crankcase oils also contain an ashless dispersant such as the polyolefin-substituted succinamides and succinimides of polyethylene polyamines such as tetraethylenepentamine. The polyolefin succinic substituent is preferably a polyisobutene group having a molecular weight of from about 800 to 5,000. Such ashless dispersants are more fully described in U.S. Pat. No. 3,172,892. Similar ashless dispersants are described in U.S. Pat. No. 3,219,666. Both are incorporated herein by reference.

Another useful class of ashless dispersants are the polyolefin succinic esters of mono- and polyhydroxy alcohols containing 1 to about 40 carbon atoms. Such dispersants are described in U.S. Pat. No. 3,381,022 and U.S. Pat. No. 3,522,179, incorporated herein by reference.

Likewise, mixed ester/amides of polyolefin substituted succinic acid made using alkanols, amines and/or aminoalkanols represent a useful class of ashless dispersants.

The succinic amide, imide and/or ester type ashless dispersants may be boronated by reaction with a boron compound such as boric acid. Likewise, the succinic amide, imide, and/or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. Nos. 3,368,972; 3,413,347; 3,442,808; 3,448,047; 3,539,633; 3,591,598; 3,600,372; 3,634,515; 3,697,574; 3,703,536; 3,704,308; 3,725,480;

3,726,882; 3,736,357; 3,751,365; 3,756,953; 3,792,202; 3,798,165; 3,798,247 and 3,803,039.

The above Mannich dispersants can be reacted with boric acid to form boronated dispersants having improved corrosion properties.

Superior results are obtained by using the present additives in crankcase lubricating oil in combination with a phosphonate additive. Preferred phosphonates are the di-$C_{1-4}$ alkyl $C_{12-36}$ aliphatic hydrocarbyl phosphonates. These compounds have the structure:

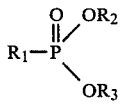

wherein $R_1$ is an alkyl or alkenyl group containing about 12–36 carbon atoms and $R_2$ and $R_3$ are independently selected from lower alkyl groups containing about 1–4 carbon atoms. Representative examples of these coadditives are:

dimethyl octadecylphosphonate
dimethyl octadecenylphosphonate
diethyl 2-ethyldecylphosphonate
ethyl propyl 1-butylhexadecylphosphonate
methyl ethyl octadecylphosphonate
methyl butyl eicosylphosphonate
dimethyl hexatriacontylphosphonate Preferred phosphonates are the di-$C_{1-4}$ alkyl $C_{12-36}$ alkylphosphonates, more preferably dimethyl $C_{12-36}$ alkylphosphonates. The most preferred coadditive is dimethyl octadecylphosphonate.

When using the phosphonate coadditive only a small amount is required. A useful range is about 0.005–0.75 weight percent based on the formulated oil. A more preferred amount is about 0.05–0.5 weight percent.

In commercial practice a preferred way to add the present additives to lubricating oil is in the form of an additive package. These are concentrates dissolved in oil which when added to a base oil will provide an effective concentration of the present additive and other known additives. For example, if the desired use level is 0.2 weight percent and the final formulated oil is made by adding 10 parts of additive package to 90 parts of base lubricating oil, then the additive pack will contain 2.0 weight percent of the present additive.

In addition to the present additives, such additive packages usually contain an ashless dispersant such as those previously discussed. In addition, the additive package may contain the phosphonate coadditive, a zinc dialkyldithiophosphate, an alkaline earth metal hydrocarbon sulfonate (either neutral or overbased), an alkaline earth metal phenate (either neutral or overbased), or similar sulfur-bridged phenates, an antioxidant such as 4,4'-methylenebis-(2,6-di-tert-butylphenol) or N-octylphenyl-α-naphthylamine, a phosphosulfurized terpene or olefin such as phosphosulfurized polyisobutylene (mol wt 1000) or alkaline earth metal salts of such phosphosulfurized olefin, a viscosity index improver such as a polyalkylmethacrylate, an ethylene/propylene copolymer, an ethylene/propylene/nonconjugated diene terpolymer, a styrene/conjugated diene copolymer, a styrene/acrylate copolymer; a styrene/acrylate/N-vinylpyrrolidone terpolymer and the like may be included in the package or may be added separately to the oil.

The following formulation illustrates a typical additive package of this invention. Parts are by weight.

product of Example 1: 1.2–12 parts
polyisobutenyl (mol wt 950) succinimide of tetraethylenepentamine: 2.9–120 parts
zinc dialkyldithiophosphate (10% Zn): 6–24 parts
calcium alkyl benzene sulfonate (TBN 300): 12–60 parts
dimethyloctadecylphosphonate: 1.2–12 parts
Acryloid 702[1]: 60–180 parts
neutral 1000 SUS mineral oil: 5–50 parts

[1]registered trademark for Rohm and Haas Company brand of polymethacrylate VI improver Tests were conducted which demonstrated the friction reducing properties of the present invention.

LFW-1 Test

In this test a metal cylinder is rotated around its axis 45° in one direction and then 45° in the opposite direction at a rate of 120 cycles per minute. A metal block curved to conform to the circular contour of the cylinder presses at a fixed load against the periphery of the cylinder. Test lubricant is applied to the rubbing surface between the cylinder and the block. Torque transmitted to the block from the oscillating cylinder is measured. The greater the torque the greater the friction. Results are given in terms of "percent improvement" which is the percent reduction in torque compared to that obtained with the test oil without the test additive.

SAE-2 Fly Wheel Test

In this test a heavy fly wheel is rotated at 1440 rpm. A series of 9 clutch plates are then brought to bear axially at a defined load against the fly wheel. The fly wheel is connected to the rotating plate. The static plates are connected to a device which measures rotational torque. The time from initially applying pressure through the clutch plate until the rotating plates stop rotating is measured. Also, the rotational torque measured at the static plates is plotted against time. Torque rises to a value referred to as "dynamic torque" and then rises to a maximum called "static torque" as the plates stop rotation. The clutch plates are immersed in test lubricant. A reduction in friction is indicated by (1) an increase in time required to stop the rotation of the moving plates and (2) a decrease in dynamic and static torque. Results are reported in percent time increase (percent improvement) and percent reduction in torque compared to that obtained using the same oil without the test additive.

The test oil is a fully formulated oil of SAE SE quality. Test results are given in the following table:

| | LFW-1 | SAE No. 2 % Improvement | | |
|---|---|---|---|---|
| Additive | % Improvement | Time Increase | Dyn. | Static |
| Example 1 (0.3%) | 9 | 7 | 8 | 19 |
| Example 1 + 0.2% dimethyl octadecyl phosphonate | 13 | 8 | 9 | 23 |

These results show that the additive significantly reduces friction and that the effect is enhanced by including a phosphonate coadditive.

We claim:

1. A lubricating oil composition formulated for use in the crankcase of an internal combustion engine, said composition containing an ashless dispersant and a friction-reducing amount of about 0.1–1.5 weight percent of a product consisting mainly of N-(2-hydroxyethyl)-fatty acid amide wherein said fatty acid contains about 12–22 carbon atoms.

2. A lubricating oil composition of claim 1 wherein said fatty acid is oleic acid.

3. A lubricating oil composition of claim 1 wherein said fatty acid is a tall oil fatty acid mixture.

4. A lubricating oil composition of claim 1 also containing about 0.005–0.75 weight percent of a di-$C_{1-4}$ alkyl $C_{12-36}$ aliphatic hydrocarbylphosphonate.

5. A lubricating oil composition of claim 4 wherein said phosphonate is dimethyl-$C_{12-36}$ alkylphosphonate.

6. A lubricating oil composition of claim 5 wherein said alkylphosphonate is dimethyloctadecylphosphonate.

7. A lubricating oil composition of claim 6 wherein said fatty acid is oleic acid.

8. A method of reducing friction in an internal combustion engine, said method comprising (1) adding to a lubricating oil a friction-reducing amount of about 0.1–1.5 weight percent of a product consisting mainly of N-(2-hydroxyethyl)fatty acid amide wherein said fatty acid contains about 12–22 carbon atoms and (2) placing said lubricating oil in the crankcase of an internal combustion engine.

* * * * *

UNITED STATES PATENT AND TRADEMARK OFFICE

CERTIFICATE OF CORRECTION

PATENT NO. : 4,293,432

DATED : October 6, 1981

INVENTOR(S) : Andrew George Papay et al

It is certified that error appears in the above-identified patent and that said Letters Patent are hereby corrected as shown below:

Cover page: "(73) Assignee: Ethyl Corporation, Richmond, Va."

should be

-- "(73) Assignee: Edwin Cooper, Inc. St. Louis, Mo. --

Signed and Sealed this

Thirteenth Day of July 1982

[SEAL]

Attest:

GERALD J. MOSSINGHOFF

Attesting Officer

Commissioner of Patents and Trademarks